United States Patent [19]

Looker et al.

[11] 4,315,350

[45] Feb. 16, 1982

[54] OVERCENTER BUCKLE

[75] Inventors: Robert Looker, Carpenteria; Richard E. McLennan, Rancho Palos Verdes, both of Calif.

[73] Assignee: Satron, Inc., El Segundo, Calif.

[21] Appl. No.: 94,579

[22] Filed: Nov. 15, 1979

Related U.S. Application Data

[63] Continuation-in-part of Ser. No. 3,544, Jan. 15, 1979.

[51] Int. Cl.[3] ..... A44B 21/00

[52] U.S. Cl. ..... 24/68 R; 24/68 CD; 24/128; 24/163 R; 24/197

[58] Field of Search ..... 24/68 R, 68 CD, 68 E, 24/68 F, 69 CT, 71 TD, 74 R, 74 A, 75, 197, 200, 163 R, 128 R, 71 R, 71 ST, 71 CT

[56] References Cited

U.S. PATENT DOCUMENTS

| | | | |
|---|---|---|---|
| 3,203,058 | 8/1965 | Roing | 24/68 F |
| 3,294,053 | 12/1966 | Emery, Jr. | 24/128 R |
| 3,335,468 | 8/1967 | Harley | 24/74 R |
| 3,449,798 | 6/1969 | Hofmann | 24/71 ST |
| 3,858,279 | 1/1975 | Brattstrom | 24/68 F |
| 3,887,966 | 6/1975 | Gley | 24/68 CD |
| 3,957,183 | 5/1976 | Gadberry | 24/197 |
| 3,999,254 | 12/1976 | McLennan | 24/74 R |
| 4,049,357 | 9/1977 | Hamisch, Jr. | 24/128 R |

FOREIGN PATENT DOCUMENTS

| | | | |
|---|---|---|---|
| 507706 | 11/1954 | Canada | 24/74 R |
| 1812916 | 7/1973 | Fed. Rep. of Germany | 24/68 F |
| 2612033 | 10/1976 | Fed. Rep. of Germany | 24/74 R |
| 7018 | of 1884 | United Kingdom | 24/163 R |

*Primary Examiner*—Victor N. Sakran

*Attorney, Agent, or Firm*—Smyth, Pavitt, Siegemund & Martella

[57] ABSTRACT

A buckle of the type used to connect belts used for tying down cargo in vehicles. The buckle is formed of flat plate stock and has a structure adapted to withstand high compressive forces such as are applied to it when it is run over by loaded vehicles. The buckle operates on an overcenter principle, so that once it is locked further tension on the belts tends to keep the buckle locked. In using the buckle, initially the free end of one belt is threaded through the buckle and pulled to take up slack. The free end is jammed between the standing end of the belt and a portion of the buckle, preventing slippage. Next, the handle of the buckle is rotated approximately 180 degrees, which causes the standing part of the belt to be wound around the buckle, thereby placing the belt in tension. Towards the end of its throw, the handle of the buckle passes to an overcenter position, in which further tension in the belt locks the buckle more securely. A safety catch is provided to insure against accidental opening of the buckle in case the cargo shifts.

12 Claims, 10 Drawing Figures

22
20
2
23
24
24
15
26
10
13
28
34
30
32
27
26
19
28
34
12
2
16
14
18

23
20
24
REAR
FRONT
13
11
20
27
13
32
34
30
28
34
16
12
14

20
4
30
31
32
27
FRONT
REAR
11
13
15
24
25
F
4
12
14
16

20
20

34
34
30
32
19
27
25
FRONT
19
27
11
15
24
24
23
14
16

8
54
48
58
15
56
24
49
33
10
10
50
26
32
30
10
8
12
16
14

54
56
58
24
10
33
50
52
32
30
16
12
14

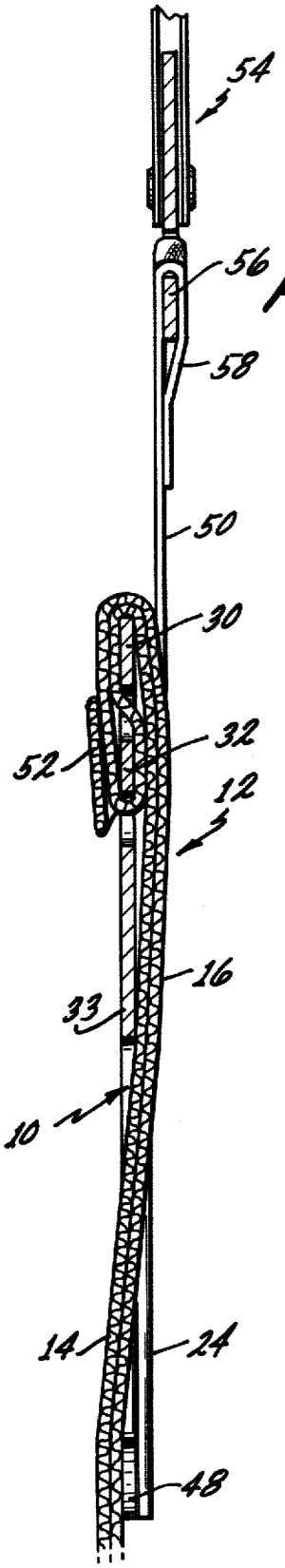
FIG. 9
FIG. 10
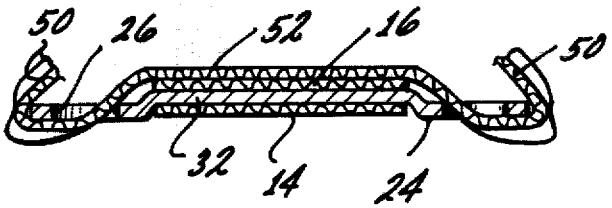

OVERCENTER BUCKLE

PRIOR APPLICATION

This application is a continuation-in-part of our prior copending U.S. application Ser. No. 003,544, filed Jan. 15, 1979.

BACKGROUND OF THE INVENTION

1. Field of the Invention

The present invention is in the field of cargo handling equipment, and more specifically relates to a buckle for use with a belt and which operates on an overcenter principle and which has an extremely simple and rugged structure.

2. The Prior Art

The overcenter principle as applied to buckles is now new. All of the known prior art overcenter buckles employ parts which move with respect to one another. Typically, such buckles had a three-dimensional structure in which flanges extended from a handle, and in which certain moving parts were mounted between the flanges.

Although the prior art overcenter buckles may have been strong enough to operate properly in their intended use, in practice their life was limited by their inability to withstand accidental mistreatment.

Typically, such buckles are used to secure belts which tie down cargo, and in this setting, cargo-moving vehicles such as forklifts not uncommonly run over the buckles, destroying them.

SUMMARY OF THE INVENTION

The present invention is a buckle which operates on an overcenter principle but which, compared to prior art buckles, is more capable of withstanding mistreatment.

In one embodiment, the buckle of the present invention is a single piece, while in other embodiments, it consists of more than one piece rigidly connected to form a solid structure.

In the preferred embodiment, the buckle is formed of flat plate stock, and has a generally flat structure. Hence, it has great resistant to damage caused by being run over by vehicles.

Because the overcenter buckle of the present invention is formed of flat plate stock, it can be stamped out of such stock and therefore is relatively inexpensive to manufacture.

In accordance with a preferred embodiment of the present invention, the buckle is aligned in its open position and the belt is threaded through it and pulled tight. Next, the handle of the buckle is swung to the locked position, winding the belt over one end of the buckle and thereby tensioning the belt. The handle is then removably attached to the tensioned belt to prevent accidental unlocking.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 9 is a sectional view, similar to FIG. 8, showing the buckle in its locked position, and FIG. 10 is a sectional view taken along the line 10—10 of FIG. 7.

DETAILED DESCRIPTION OF THE PREFERRED EMBODIMENT

Figure 1:
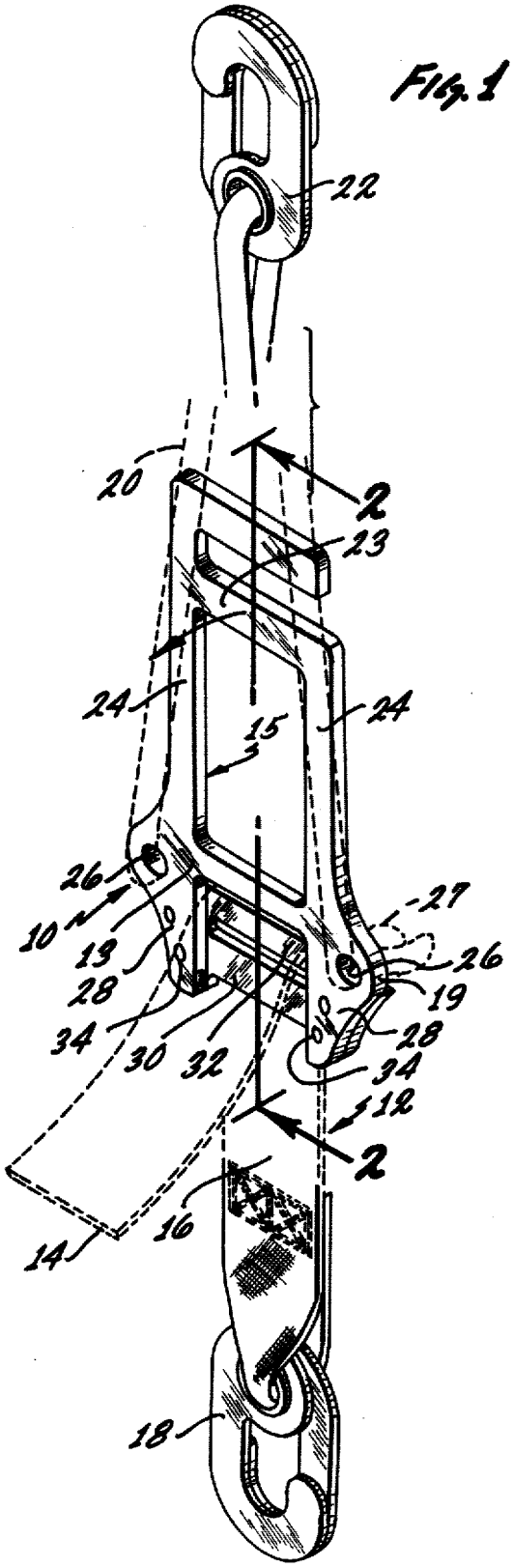
FIG. 1 is a perspective view of a preferred embodiment of the buckle in its open position.
Figure 2:
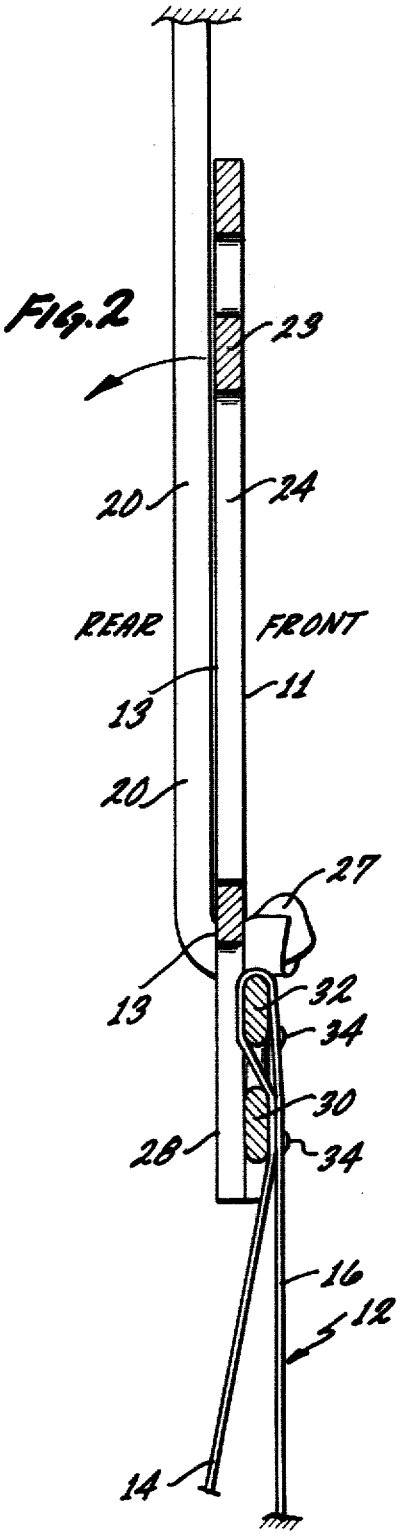
FIG. 2 is a cross-sectional view taken in the direction 2—2 of FIG. 1 showing a preferred embodiment of the buckle in its open position.

Turning now to the drawings, in which like parts are denoted by the same reference numeral throughout, there is shown in FIGS. 1 and 2 a preferred embodiment of the overcenter buckle of the present invention in its open position. The essential parts of the buckle 10 are the handle 15 and the cross members 30, 32. Both the handle 15 and the cross members 30, 32 are formed of flat plate stock, and the handle includes a front surface 11 and a rear surface 13. The cross members 30, 32 are attached to the front surface 11 by the rivets 34.

The buckle 10 is normally permanently connected by a rope 20 to a clasp 22 leading off in a first direction. The rope 20 passes from the rear surface 13 forward through the eyes 26, and is retained from pulling through the eyes by knots 27 tied at the ends of the loop or rope 20.

Typically, the buckle is used to secure a belt or strap 12 to the rope 20 for the purpose of restraining the movement of cargo on a vehicle. The strap or belt 12 includes a free end 14 as well as a standing part 16. The standing part 16 extends in the opposite direction from the rope 20 and terminates in a clasp 18. The clasps 18, 22 are normally engaged to fittings on the vehicle, and the belt 12 normally partially encircles the cargo. In use, the free end 14 of the belt 12 is threaded through the buckle 10 as shown in FIG. 2, with the buckle 10 in its open position. It is seen that a bight is formed in the belt 12 which encircles the retaining cross member 32 and that the free end 14 of the belt is jammed between the standing part 16 and the first cross member 30. Thereafter, the handle 15 is pulled in the direction of the arrow in FIG. 2 relative to the rope 20 and rotated through an angle of approximately 180 degrees, so that the buckle 10 assumes the locked or closed position shown in FIGS. 3 and 4. In moving the handle 15 in the direction of the arrow, the upper part of the handle passes through a loop, as indicated, that may be formed in the rope 20. Also, of course, the loop may pass in front of the handle 15, i.e., to the right of the handle as shown in FIG. 2 or behind the handle as shown in FIG. 1, if the loop is smaller than the upper part of the handle such that the upper part of the handle could not pass through the loop.

Figure 3:
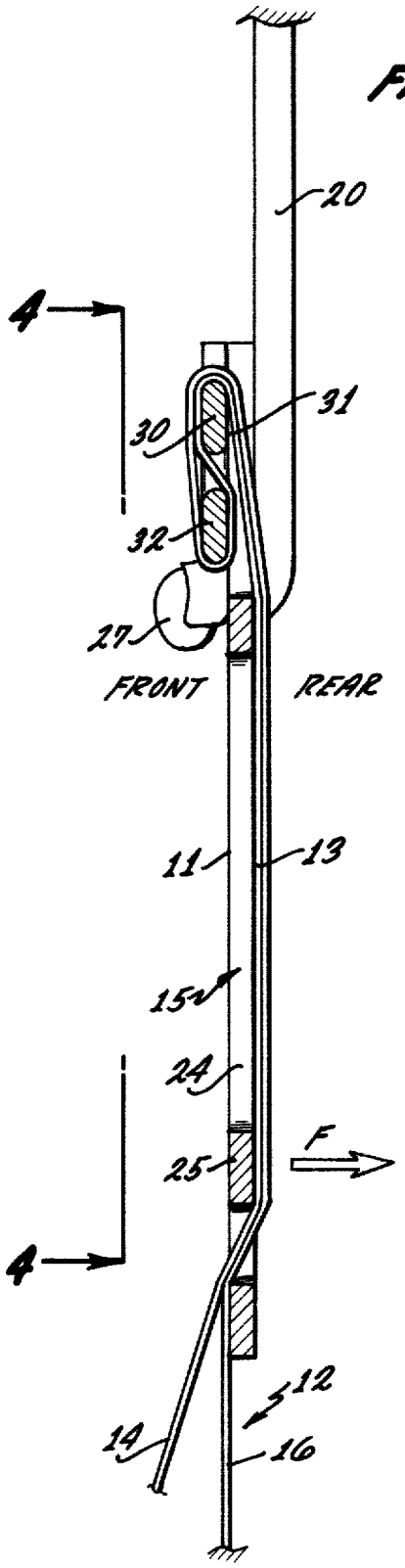
FIG. 3 is a side cross-sectional view of a preferred embodiment of the buckle in its locked position.
Figure 4:
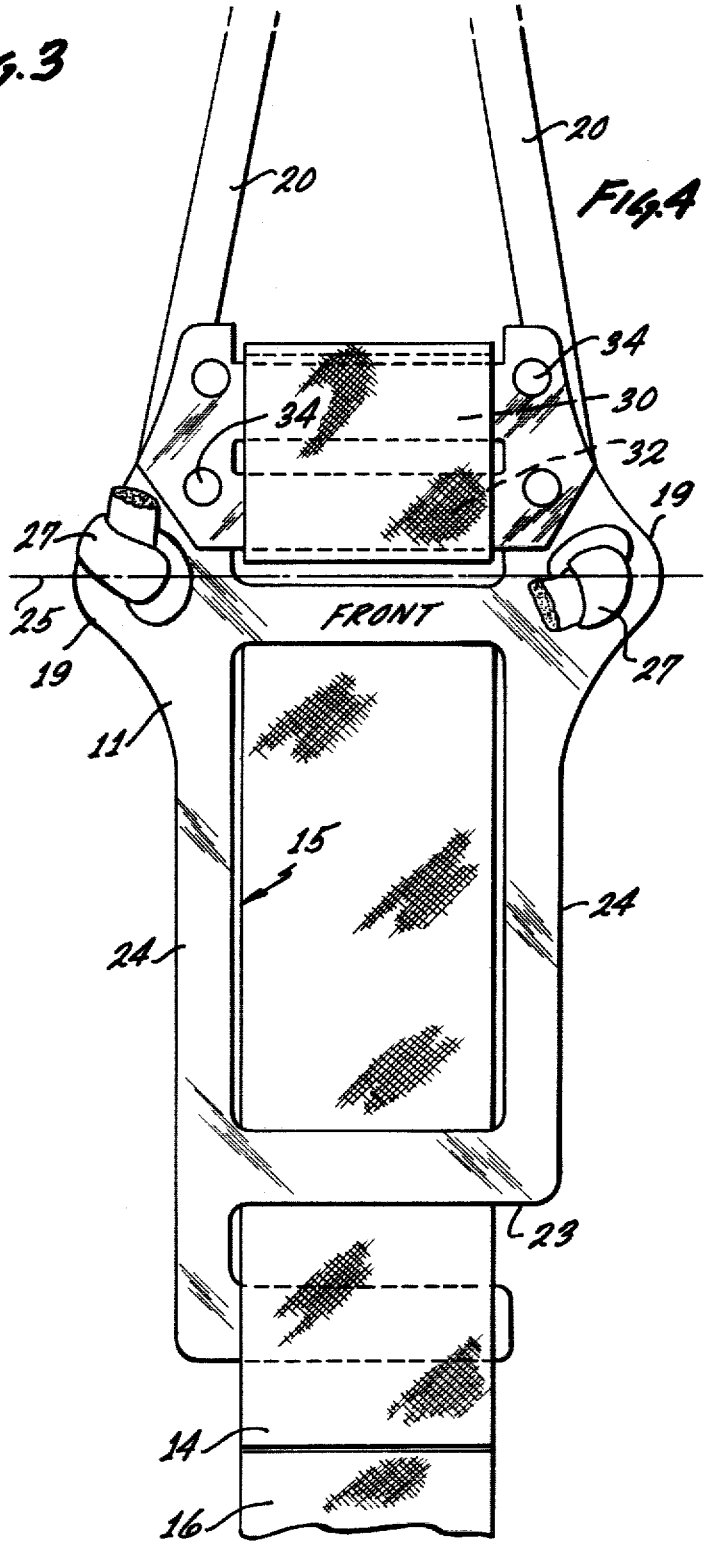
FIG. 4 is a plan view in the direction 4—4 of FIG. 3 showing a preferred embodiment of the present invention in its locked position.

As the handle 15 is rotated to the locked position in the direction of the arrow in FIG. 2, slack in the belt 12 is taken up as the belt is wound around the first cross member 30, as the latter moves from a position below the knot 27 as shown in FIG. 2 to the locked position in which the first cross member 30 is above the knot 27, as shown in FIGS. 3 and 4. The rotation of the handle 15 takes place about the line 25 which is defined by the centers of the eyes 26. The tensioning of the belt 12 which occurs as the handle 15 is rotated places the belt 12 and the rope 20 under tension. This tension is found to produce a torque on the handle 15, tending to rotate it in the direction shown by the arrow F in FIG. 3, i.e., forcing the end 23 of the handle against the belt 12. The force increases with increasing tension in the belt 12, preventing the buckle from being pulled open. A safety catch 29 is provided to insure that the buckle will stay closed even if the cargo shifts in such as manner as to relieve temporarily the tension in the belt 12. The locking action of the buckle is believed to result from the fact that the rear surface 31 of the first cross member 30 is located in front of the rear surface 13 of the handle 15 as shown in FIG. 3. In the best mode of constructing the buckle, the offset between the rear surface of the first cross member 31 and the rear surfaces 13 of the handle 15 is relatively small to prevent the locking force on the end of the handle 23 from becoming so large that the buckle cannot be rotated again to its open position. Typically, the force on the end of the handle should not excees 20 pounds, while the tension in the belt 12 may be on the order of several thousand pounds.

In the preferred embodiment of FIGS. 1–4, it is desirable that the eyes 26 extend laterally from the opposite sides 24 of the handle 15, so that as the buckle is rotated, the rope 20 can pass readily around the outside 19 of the eyes 26.

Another feature common to all embodiments of the buckle is that the location of the retaining cross member 32 is immaterial. For example, in the embodiment of FIGS. 1–4, the structural brace 33 interconnecting the handle sides 24 could have served as the retaining cross member. The embodiment of FIGS. 1–4 is particularly sturdy and able to resist mistreatment such as the strong compressive forces applied to the buckle when it is run over by the wheel of a vehicle. It is recognized that other embodiments can be used, such as that shown in FIG. 5 in its open condition and in FIG. 6 in its locked position.

Figure 5:
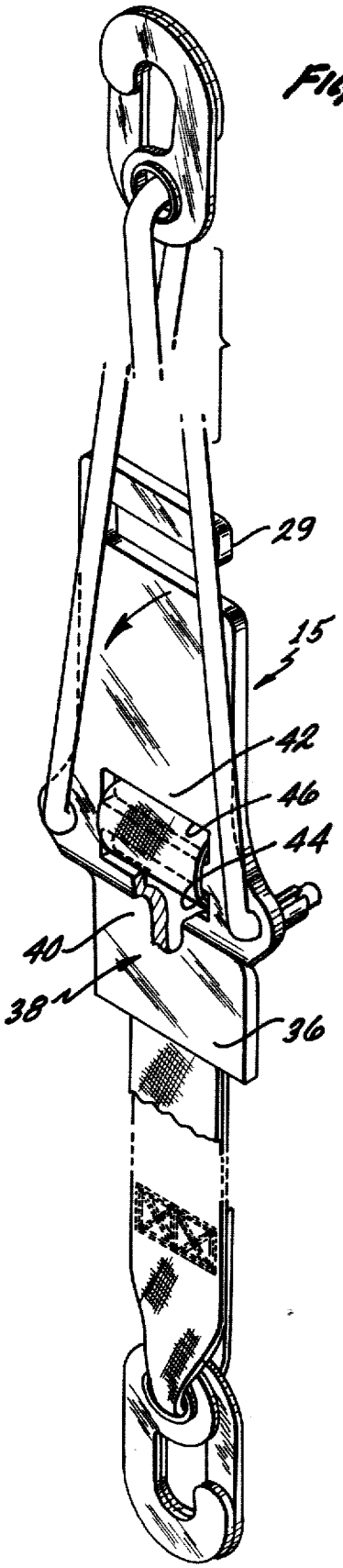
FIG. 5 is a perspective view of an alternative embodiment of the present invention in its open position.
Figure 6:
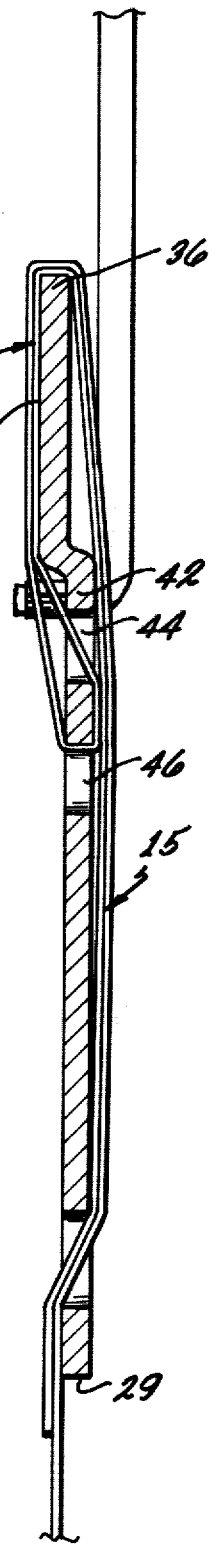
FIG. 6 is a cross-sectional view of the alternative embodiment shown in FIG. 5 in a direction 5—5, showing the alternative embodiment in its locked position.

In the embodiment of FIGS. 1–4, the cross members 30, 32 were attached to the legs 28 which extend perpendicularly to the line adjoining the eyes 26. In contrast, in the embodiment of FIGS. 5 and 6, a one-piece construction of the buckle is employed. In the embodiment of FIGS. 5 and 6, the end edge 36 replaces the first cross member 30 of the embodiment of FIGS. 1–4.

The offset produced in the embodiment of FIGS. 1–4 by attaching the cross members 30, 32 to the front surface 11 of the handle 15 is produced in the embodiment of FIGS. 5 and 6 by joggling the end portion 38 with respect to the plane of the handle 15, so that the rear surface 40 of the end section 38 lies in front of the rear surface 42 of the handle 15. In moving the handle 15 from its unlocked position in FIG. 5 to its locked position of FIG. 6, the handle is rotated in the direction of the arrow indicated in FIG. 5. During this movement, the upper portion of handle 15 passes through the loop in the rope as indicated in FIG. 5. The loop may be positioned in front of the handle 15, i.e., with the upwardly extending portions of the rope passing behind the handle, as shown in FIG. 5. When the loop is too small for the handle 15 to move through the loop in rotating to its locked position, it is, of course, necessary that the loop be positioned in front of the handle in its unlocked position.

In the embodiment of FIGS. 5 and 6, the retaining means is a strip of material lying between two apertures 44, 46 through the handle 15. It is recognized that in other embodiments, the retaining means could take the form of a bar-like member attached to the handle and spanning an opening in the handle, as in the embodiment of FIGS. 1–4.

Figure 7:
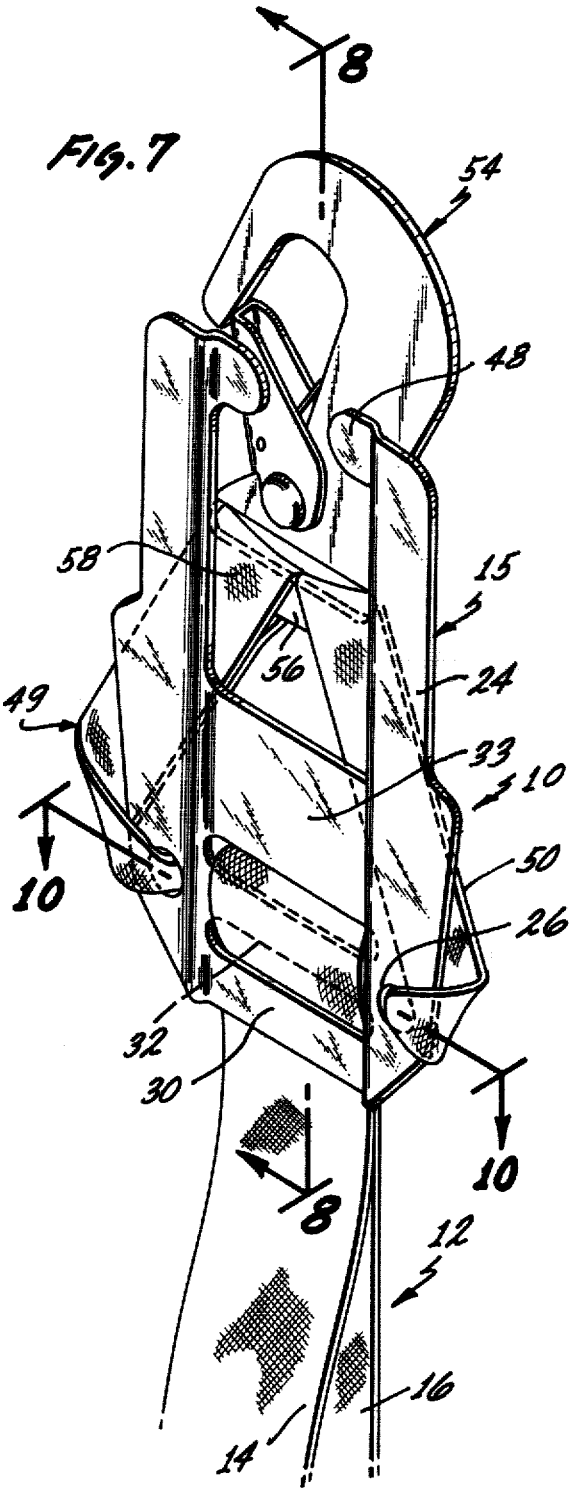
FIG. 7 is a perspective view of a further embodiment of the invention in its open position.

FIG. 7 is a perspective view of another embodiment of the invention in which the buckle 10 is a one-piece construction with the belt or strap 12 being looped over the cross member 32 shown in phantom line drawing. As indicated, the opposite sides 24 of the handle 15 lie in one plane while the cross member 30, cross member 32 and the structural brace 33 lie in a plane which is offset from and lies behind the plane of the handle sides 24 as shown in FIG. 7. A pair of safety catches 48 may be formed at the upper end of the handle sides 24, as indicated, with the region between the handle sides being open.

A strap, generally indicated as 49, may pass through the eyes 26 formed in the handle sides 24 while upwardly extending strap portions 50 pass behind the handle 15 to a clasp 54. As indicated, the upwardly extending strap portions 50 are connected to a cross member 56 with looped ends 58 of the upwardly extending portions extending around the cross member. The cross member 56 may be joined to the clasp 54 in any convenient manner such that the cross member and clasp are structurally integral. The upwardly extending strap portions 50, being joined together through their connection to the cross member 56, form a loop which lies behind the handle 15 as shown in FIG. 7. In moving the buckle 10 to its locked position, as will be described, the handle 15 is merely pulled away from the loop formed by the upwardly extending strap portions 50 in the same general manner as described previously with regard to FIGS. 1–6.

Figure 8:
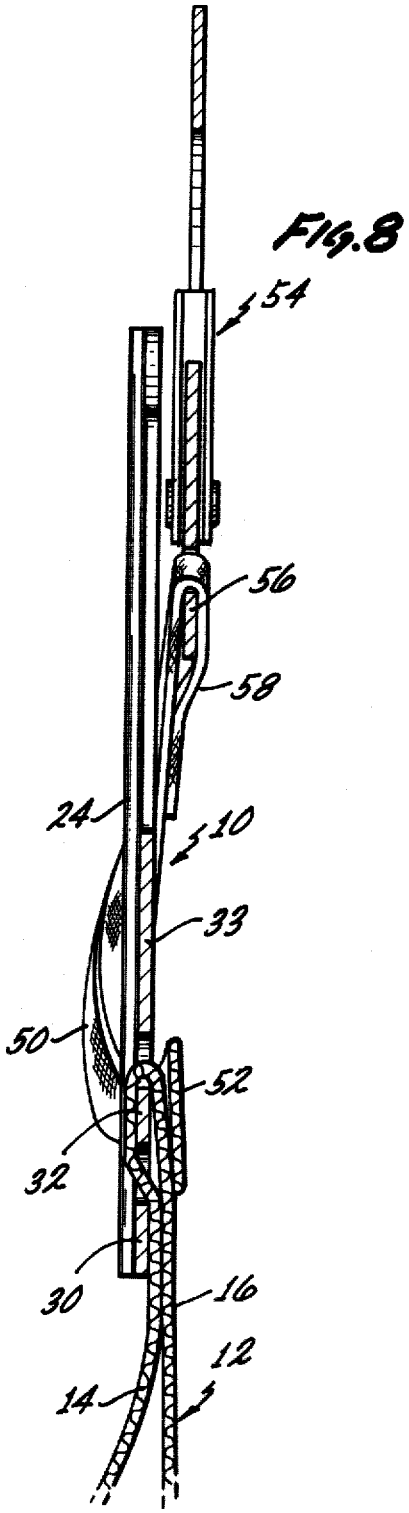
FIG. 8 is a sectional view taken along the line 8—8 of FIG. 7.

FIG. 8 is a sectional view taken along the line 8—8 of FIG. 7 which illustrates the buckle 10 in its open position. As indicated, the cross members 30 and 32 lie in a plane which lies to the right of the plane of the handle sides 24 as shown in FIG. 8. The eyes 26 (see FIG. 7) pass through the handle sides 24 while the belt or strap 12 passes over the cross member 32. Accordingly, if a downward force is exerted on the belt or strap 12 with the buckle 10 in its position as shown in FIG. 8, the force tends to rotate the buckle in a clockwise direction from that shown in FIG. 8. As indicated, after passage of the upwardly extending strap portions 50 through the eyes 26, the strap portions which extend through the eyes are joined together by a connecting strap portion 52.

FIG. 9 is a sectional view, similar to FIG. 8, which illustrates the buckle 10 after rotation about a line through the eyes 26 (see FIG. 7) to its locked position. In its locked position, the buckle 10 is inverted with the strap 12 passing over the cross member 30 which now lies above the cross member 32. With the buckle 10 in its locked position, the plane of the cross members 30 and 32 now lies to the left of the plane of the handle sides 24 through which the eyes 26 extend (see FIG. 7). Accordingly, when a downward force is exerted on the strap 12 with the buckle 10 in the position shown in FIG. 9, the force tends to rotate the buckle in a counterclockwise direction from its position shown in FIG. 9. If desired, the belt ends 14 and 16 may extend through the opening between the handle sides 24 to engage the safety catches 48. However, is it not essential that the belt 12 pass through the opening between the handle sides 24 or that it engage the safety catches 48 in order for the buckle 10 to function as an overcenter device.

FIG. 10 is a sectional view taken along the line 10—10 of FIG. 7. As indicated, the plane of the cross member 32 about which the belt ends 14 and 16 are looped is offset from the plane of the handle sides 24 through which the eyes 26 extend. The cross member 30 lies in the same plane as the cross member 32 and the position of the cross member 32 as shown in FIG. 10 is, therefore, also indicative of the position of cross member 30. As indicated, the plane of the cross members 30 and 32 lies to one side of the plane of the handle sides 24 when the buckle 10 is in its open position as shown in FIG. 7. However, when the buckle 10 is rotated to its locked position as shown in FIG. 9, the plane of the cross members 32 and 30, in effect, flips over such that the plane of the cross members now lies on the opposite side of the plane of the handle sides 26. This explains the manner in which the buckle 10 functions as an overcenter device.

Thus, there has been described a locking buckle formed of flat plate stock and having a configuration which renders it highly resistant to damage caused by mistreatment.

The foregoing detailed description is illustrative of several embodiments of the invention, and it is to be understood that additional embodiments thereof will be obvious to those skilled in the art. The embodiments describe, herein, together with those additional embodiments, are considered to be within the scope of the invention.

What is claimed is:

1. A relatively flat overcenter buckle of the type which is connected to a loop of a connector extending in a first direction from the buckle and which is used for tensioning and removably securing to the buckle a belt extending in an opposite direction from the buckle through overcenter action of said buckle in which tension tends to keep said buckle in a locked position, said buckle comprising:

a handle having a front surface and a rear surface, the handle having a pair of opposite sides with each side having an eye large enough for the connector to pass through and the eyes extending from each of said opposite lines along a line extending across said handle, the handle having two parallel legs extending perpendicularly to said line and spaced apart a distance sufficient to accommodate the width of the belt with clearance;

a first cross member joined to said handle and extending parallel to said line across the space between the legs and located in a plane which is offset with respect to the sides of said handle;

said handle being pivotable along an axis formed by said line between an unlock position in which the tension is released to a lock position in which the tension cooperates with the offset of said first cross member to retain said buckle in said locked position;

said handle and cross member being a unitary structure; and, retaining means for retaining a loop of the belt to said handle.

2. The buckle of claim 1 wherein said retaining means includes a second cross member extending parallel to said line.

3. The buckle of claim 2 wherein in the locked position of said buckle, the belt passes around said first cross member, and in the unlocked position passes only around said second cross member.

4. The buckle of claim 1 wherein said retaining means further comprise a portion of said handle included between two spaced apertures in said handle.

5. The buckle of claim 1 further comprising:

a connector, each end of which passes through one of said eyes from the rear surface; and, means to prevent the ends of the connector from being withdrawn through the eyes.

6. The buckle of claim 1 further comprising:

a belt having a free end and a standing part, the free end being doubled back on the standing part to form a bight, the bight retained by said retaining means with the free end being between the standing part and said first cross member in one position of the buckle and in another position of the buckle being looped around said retaining means.

7. The buckle of claim 1 further comprising:

safety means in said handle for removably engaging an end of said handle opposite said first cross member with the belt.

8. An overcenter buckle of the type which is connected to a loop of a connector extending in a first direction from the buckle and which is used for tensioning and removably securing to the buckle a belt extending in an opposite direction from the buckle, said buckle comprising:

a handle having a front surface and a rear surface, the handle having a pair of opposite side edges with an eye extending from each of said opposite side edges along a line extending across said handle, each eye being large enough for the connector to pass through and said handle having a cross member parallel to said line and located in a plane which is offset with respect to the side edges;

retaining means for removably retaining a loop of the belt to said handle such that the free end of said belt is positioned adjacent said cross member; and, said handle being pivotable about an axis defined by said line such that in the locked position the handle overlies said belt with said free end of said belt positioned around said cross member and, in the unlocked position, the belt is positioned around only said retaining means.

9. The buckle of claim 8 wherein said retaining means further comprise a portion of said handle included between two spaced apertures in said handle.

10. The buckle claim 8 wherein said retaining means further comprise a bar-like member joined to said handle to span an opening in said handle.

11. The buckle of claim 8 further comprising:

a connector, each end of which passes through one of said eyes from the rear surface; and, means to prevent the ends of the connector from being withdrawn through the eyes.

12. The buckle of claim 8 further comprising:

safety means in said handle for removably engaging an end of said handle opposite said end edge with the belt.

* * * * *